US008844638B2

(12) United States Patent
Thornburrow

(10) Patent No.: US 8,844,638 B2
(45) Date of Patent: Sep. 30, 2014

(54) TOOL FOR REMOVING WELLHEAD COMPONENTS

(75) Inventor: Edward T. Thornburrow, Drighlington (GB)

(73) Assignee: Cameron International Corporation, Houston, TX (US)

( * ) Notice: Subject to any disclaimer, the term of this patent is extended or adjusted under 35 U.S.C. 154(b) by 196 days.

(21) Appl. No.: 13/499,351

(22) PCT Filed: Jan. 27, 2012

(86) PCT No.: PCT/US2012/022925

§ 371 (c)(1),
(2), (4) Date: Mar. 30, 2012

(87) PCT Pub. No.: WO2012/103449

PCT Pub. Date: Aug. 2, 2012

(65) Prior Publication Data

US 2012/0305237 A1 Dec. 6, 2012

(30) Foreign Application Priority Data

Jan. 28, 2011 (GB) ..... 1101467.7

(51) Int. Cl.
*E21B 33/068* (2006.01)
*E21B 17/02* (2006.01)
*E21B 33/03* (2006.01)

(52) U.S. Cl.
CPC ..... *E21B 17/021* (2013.01); *E21B 33/03* (2013.01)
USPC ..... 166/386; 166/384; 166/242.2; 464/52

(58) Field of Classification Search
CPC ..... E21B 33/068; E21B 34/02; E21B 17/20; F16C 1/04; F16C 1/10
USPC ..... 166/338–340, 242.2, 377, 384, 386; 175/77, 78, 320, 321; 81/64, 65.2, 81/57.43, 177.6; 464/119, 147, 149, 52, 464/53
See application file for complete search history.

(56) References Cited

U.S. PATENT DOCUMENTS

| | | | | |
|---|---|---|---|---|
| 1,315,806 A | | 9/1919 | Wilson | |
| 1,866,714 A | * | 7/1932 | King | 408/127 |
| 1,903,660 A | * | 4/1933 | Smith et al. | 81/57.43 |
| 2,054,138 A | | 9/1936 | Sandell | |

(Continued)

FOREIGN PATENT DOCUMENTS

CN 101514612 8/2009

OTHER PUBLICATIONS

Walker, Foreign Search Report for GB1101467.7, dated Apr. 15, 2011.

(Continued)

*Primary Examiner* — Blake Michener
(74) *Attorney, Agent, or Firm* — Eubanks PLLC

(57) ABSTRACT

A tool (10) for installing and removing a valve removal plug (60) from wellhead components, the tool comprising a curved pressure containing housing (11) having a first and a second end (12, 13), the housing having a bore (20) extending from the first end to the second end, a flexible drive member (21) within the bore and drive means (40, 41) connected to the drive member for causing rotational movement of the drive member within the pressure containing housing.

8 Claims, 6 Drawing Sheets

(56) References Cited

U.S. PATENT DOCUMENTS

| | | | | | |
|---|---|---|---|---|---|
| 2,250,244 | A | * | 7/1941 | Yancey | 29/213.1 |
| 2,957,353 | A | * | 10/1960 | Babacz | 74/502.6 |
| 3,399,584 | A | | 9/1968 | Lewicki | |
| 4,077,234 | A | * | 3/1978 | Crochet, Sr. | 464/119 |
| 4,184,504 | A | * | 1/1980 | Carmichael et al. | 137/15.17 |
| 4,362,520 | A | | 12/1982 | Perry | |
| 4,392,256 | A | * | 7/1983 | Russell | 455/345 |
| 4,448,247 | A | | 5/1984 | Reed | |
| 4,460,039 | A | | 7/1984 | Knight et al. | |
| 4,503,879 | A | * | 3/1985 | Lazarus | 137/315.41 |
| 4,555,238 | A | * | 11/1985 | Miller et al. | 464/52 |
| 4,730,960 | A | | 3/1988 | Lewis et al. | |
| 4,875,523 | A | * | 10/1989 | Thornburrow | 166/77.4 |
| 5,078,650 | A | * | 1/1992 | Foote | 464/104 |
| 5,755,731 | A | * | 5/1998 | Grinberg | 606/170 |
| 5,871,031 | A | | 2/1999 | Greinacher | |
| 5,927,405 | A | * | 7/1999 | Monjure et al. | 166/384 |
| 8,191,622 | B2 | * | 6/2012 | Comeaux et al. | 166/88.4 |
| 2002/0157506 | A1 | | 10/2002 | Schade | |
| 2004/0256096 | A1 | * | 12/2004 | Adams | 166/85.1 |
| 2005/0077043 | A1 | | 4/2005 | Dallas | |
| 2006/0137882 | A1 | | 6/2006 | McGuire et al. | |
| 2008/0202770 | A1 | * | 8/2008 | Bolding et al. | 166/386 |
| 2009/0260834 | A1 | | 10/2009 | Henson et al. | |
| 2010/0018721 | A1 | * | 1/2010 | Jennings et al. | 166/385 |
| 2010/0319933 | A1 | | 12/2010 | Baugh | |
| 2011/0083534 | A1 | * | 4/2011 | Kozak et al. | 81/177.8 |
| 2012/0285678 | A1 | * | 11/2012 | Thornburrow et al. | 166/206 |

OTHER PUBLICATIONS

International search report and written opinion for application No. PCT/US2012/022925 mailed May 15, 2012.

* cited by examiner

TOOL FOR REMOVING WELLHEAD COMPONENTS

TECHNICAL FIELD

This invention relates to a tool for use in installing and retrieving items inserted into the outlets of wellhead components, the wellhead components being located either in subsea or land based wells, typically used for extracting hydrocarbons from the ground.

The invention is described in this specification as being a tool for installing and removing a valve removal plug, but the tool can be used for installing and removing other components.

BACKGROUND

In easy access situations, valve removal tools are well known for extracting valve removal plugs and the like from outlets in wellhead components. However, a major drawback of the conventional devices is that the size of these regular tools, typically the length, does not allow their use in restricted space situations, for example, on platform installations, due to the proximity of pipework, bulkheads or adjacent wellheads. In such restricted spaces, the valve removal plug engagement end of the tool simply cannot be correctly engaged with the valve removal plug, nor can the appropriate torque be applied to the plug so as to enable installation or removal.

Furthermore, the torque which these devices must apply can be up to 1000 Nm (750 lb ft) or even greater, and therefore the structure must be sufficiently robust to achieve this.

Finally, the portion of the tool which actually removes the relevant item, namely the valve removal plug or the like, is exposed to the pressures from the wellhead component from which the plug has been removed, and therefore at least the portion of the tool which contacts the wellhead component and which removes the valve removal plug needs to be pressure containing.

SUMMARY

Accordingly, it is an aim of the present invention to provide a tool which can operate in confined spaces but which is sufficiently robust to transmit the high levels of torque required and to contain the pressures from inside the wellhead components.

According to the present invention, there is provided a tool for installing and removing a valve removal plug from wellhead components, the tool comprising:

a curved pressure containing housing having a first and a second end, the housing having a bore extending from the first end to the second end;

a flexible drive member within the bore; and a drive means connected to the drive member for causing rotational movement of the drive member within the pressure containing housing.

Thus, the present invention provides a curved housing through which in use drive can be applied, such that the flexible drive member which, in use, contacts the element being installed or removed, can turn through the extent of the curved housing, and the tool can transmit torque around the curve. The tool can therefore be inserted into smaller gaps than previous tools.

In particular, the overall length of a conventional tool may be, for example, one meter, such that at least a one meter gap between the insertion point and any adjacent components is necessary. However, with the present invention, and by using a curved pressure containing housing through which the drive member passes, this gap can be reduced significantly. For example, the gap can be reduced to at least half of the necessary gap associated with a straight tool, or preferably to a gap which is no more than one quarter of the overall length of the conventional tool.

The drive means may be configured to additionally cause axial movement, as well as rotational movement of the drive member within the pressure containing housing, such that the flexible drive member can be caused to move through the pressure containing housing and into the well component to which the tool has been connected, thereby enabling items which are located inside the wellhead component to be installed or retrieved.

The curved pressure containing housing preferably curves through substantially 90°, although other angles are possible. In particular, should a smaller angle such as 45° or 60° be necessary, then the housing may be curved appropriately.

Preferably, the housing is substantially rigid and has a predefined curved shape.

The flexible drive member preferably includes a plurality of articulated joints. Adjacent articulated joints are preferably angled at no more than 15° with respect to each other, such that a 90° curve can be achieved with the use of seven drive member sections and six joints.

The pressure containing housing preferably includes a swivel flange at the first end for engagement to the wellhead component to which the tool is being attached.

The drive means is preferably connected to the pressure containing housing at the second end, opposite the first end.

The drive means may include a hydraulically operated piston causing axial movement of the drive member and the piston may be part of a hydraulic cylinder which includes a first part slidable relative to a second part.

The first part of the hydraulic cylinder is preferably connected to the drive member and the first part is preferably operable to move relative to the second part under hydraulic pressure. The hydraulic cylinder is preferably connected to means for causing rotation of the first part of the hydraulic cylinder which, by virtue of the connection to the drive member, causes rotation of the drive member and enables rotation of the item being installed or removed.

Double barrier packings are preferably used to separate a first pressure zone in the pressure containing housing from a second pressure zone in the hydraulic cylinder.

BRIEF DESCRIPTION OF THE DRAWINGS

One example of the present invention will now be described with reference to the accompanying drawings, in which.

DETAILED DESCRIPTION OF SPECIFIC EMBODIMENTS

Figure 1:
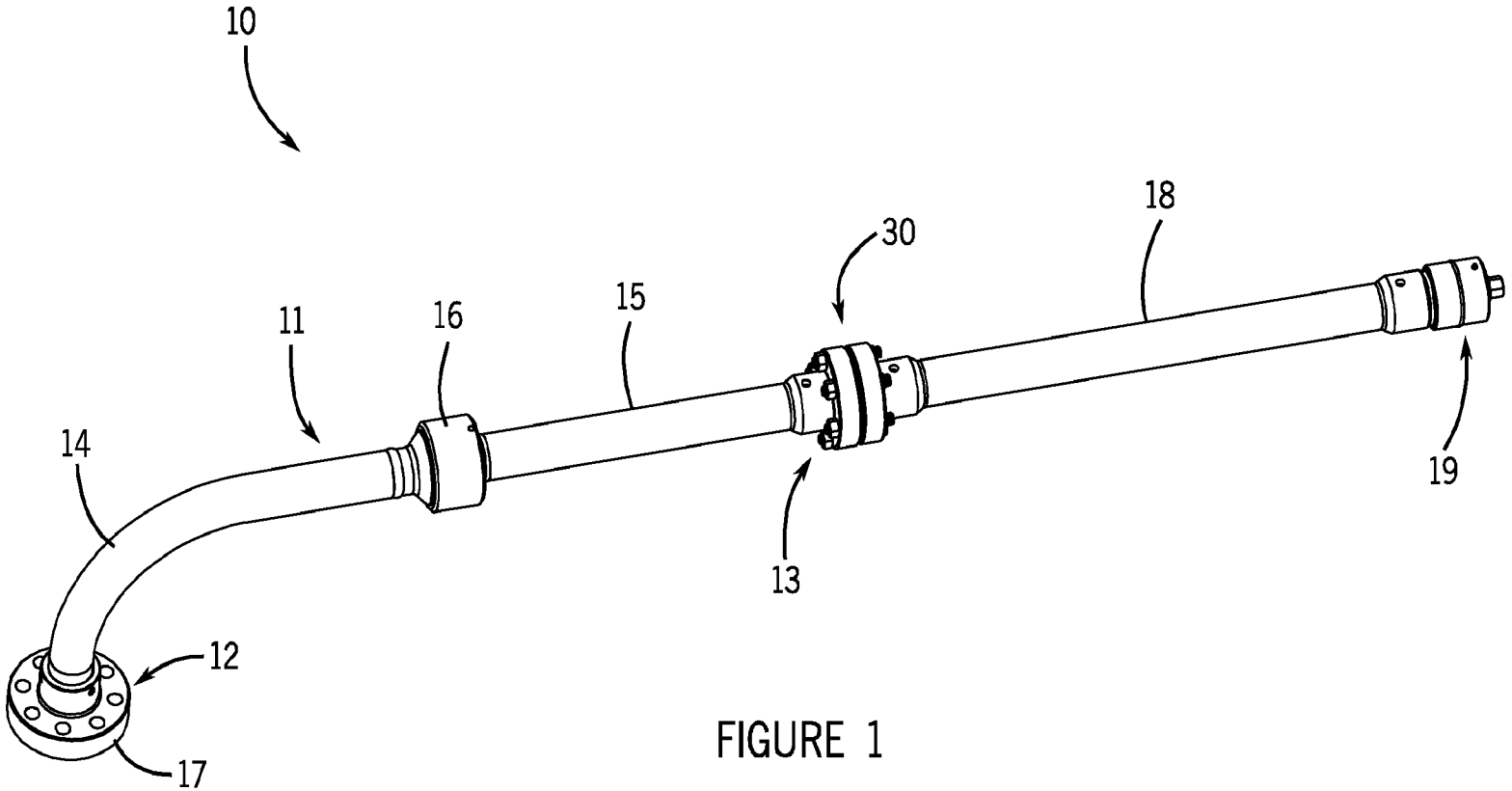
FIG. 1 is a perspective view of a tool according to the present invention.

FIG. 1 shows a tool 10 for the installation and removal of amongst other things, valve removal plugs. The tool 10 comprises a curved pressure containing housing 11 having a first end 12 and a second end 13. The pressure containing housing 11 is made up of a curved section 14 and a substantially straight section 15, the sections being connected at joint 16 shown in more detail in FIG. 3.

Figure 4:
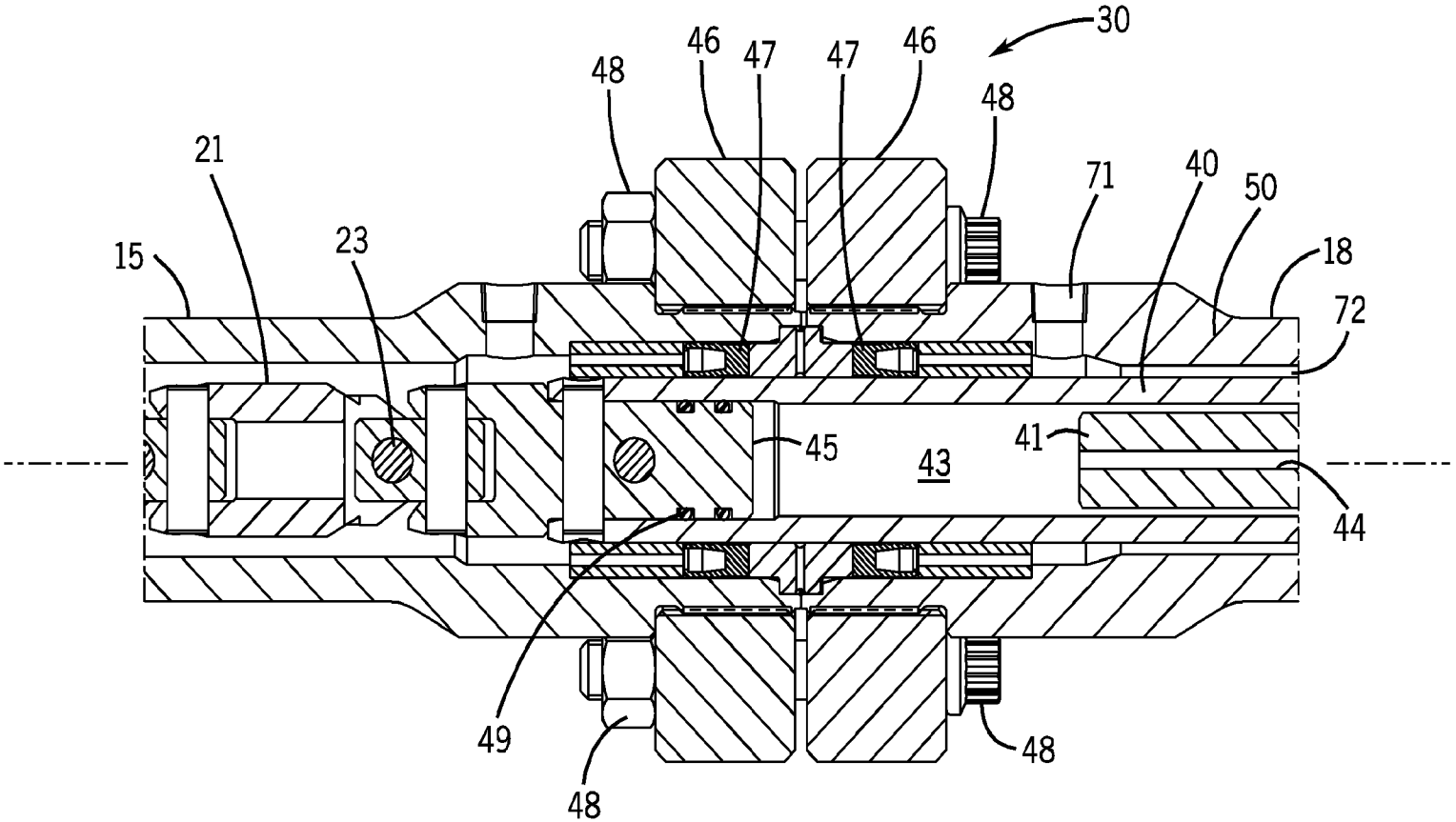
FIG. 4 is a close up view of the area identified by line 4-4 in FIG. 2.
Figure 5:
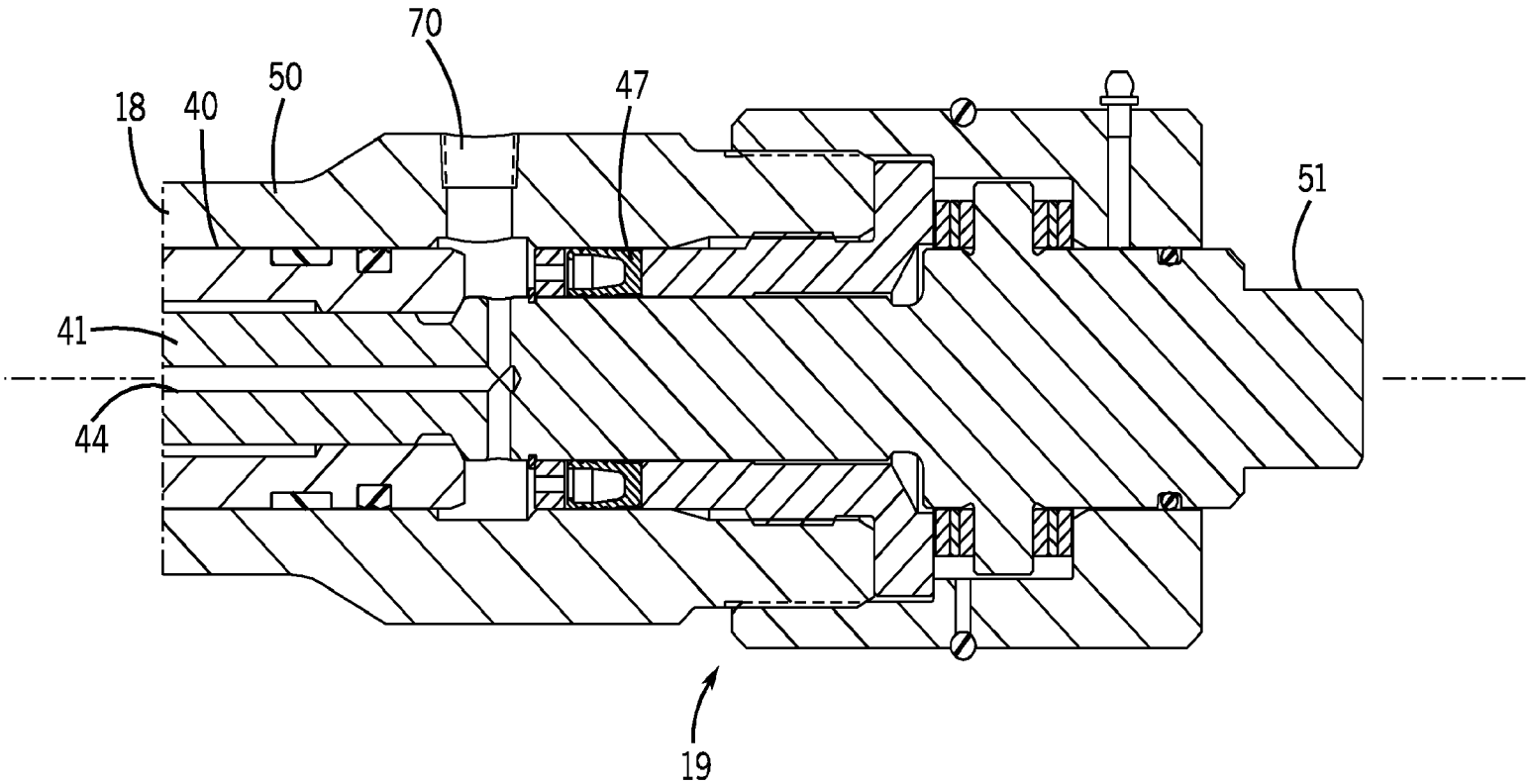
FIG. 5 is a detailed view of the area identified by line 5-5 in FIG. 2.
Figure 6:
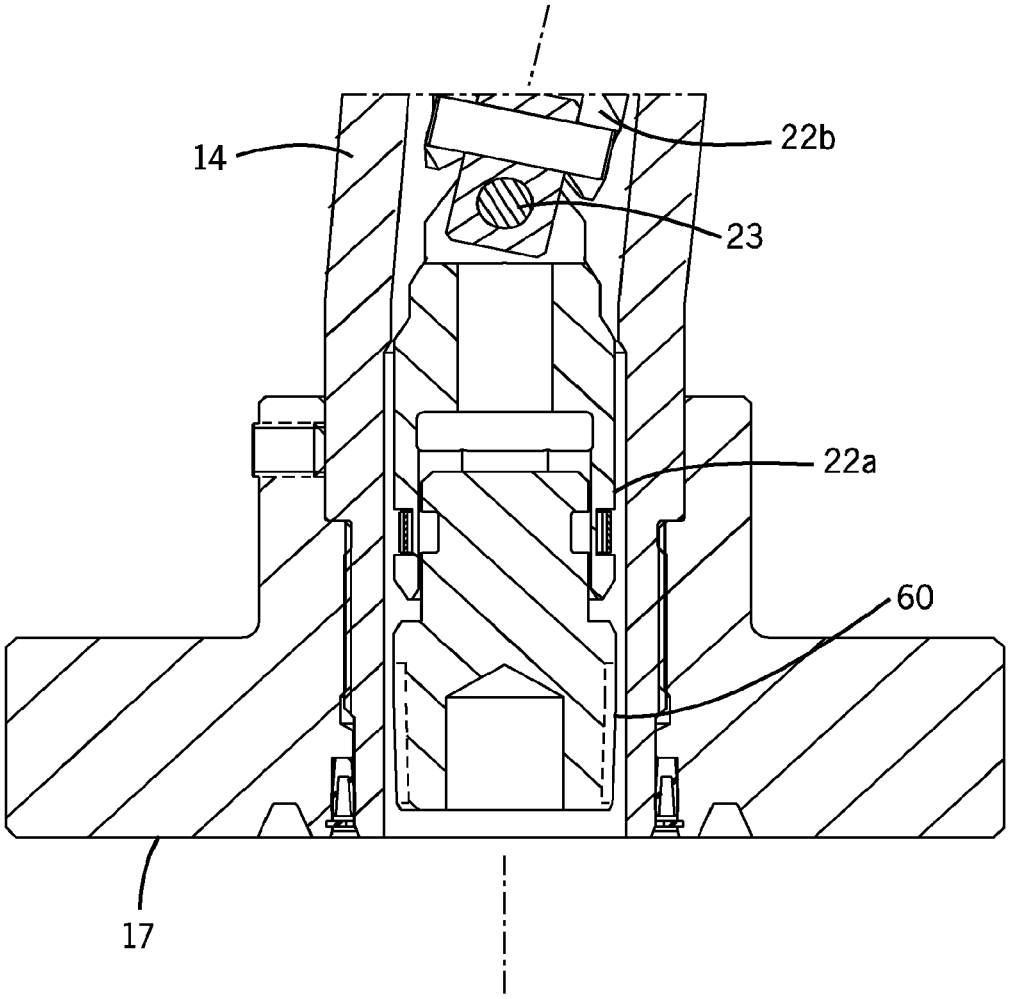
FIG. 6 is a close up view of the area identified by line 6-6 in FIG. 2.

The first end 12 is connected to a swivel flange 17 shown in greater detail in FIG. 6 and the second end 13 is connected to a hydraulic cylinder 18 at joint 30, which is shown in more detail in FIG. 4. The hydraulic cylinder 18 includes a rotatable end 19 shown in greater detail in FIG. 5.

Figure 2:
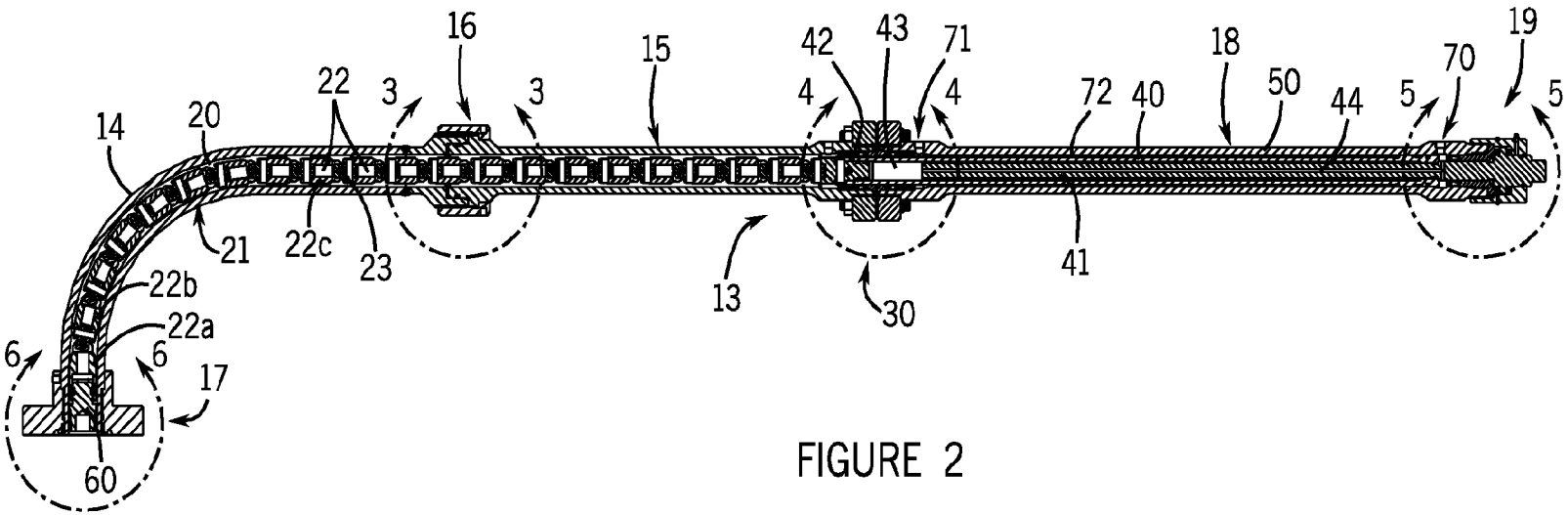
FIG. 2 is a cross sectional view through the tool of FIG. 1.

As can be seen in FIG. 2, the pressure containing housing 11 includes both the curved section 14 and the straight section 15 that define a bore 20 extending from the first end 12 to the second end 13. The bore 20 houses a flexible drive member 21 made up of a series of rod sections 22, adjacent ones of which are connected via an articulated joint 23. Articulated joint 23 typically takes the form of a universal joint, such that, irrespective of the rotational position of the drive member, the necessary curve to fit within the pressure containing housing can be maintained.

As can also be seen in FIG. 2, the curved portion 14 of the pressure containing housing is curved through 90°. Within the curved section, the first element 22*a* of the drive member 21 is a socket for connection, in use, to a valve removal plug 60 as shown in FIG. 6. The adjacent element 22*b* is angled at approximately 13° with respect to socket 22*a* (there being seven joints making up the 90° curve) with subsequent elements being angled in a similar manner to the previous elements until element 22*c* is reached.

The flexible drive member extends through additional rod members and articulated joints up to the second end 13, at which point the pressure containing housing connects to the hydraulic cylinder 18 at joint 30. By virtue of this long straight section, the drive element 21 can be moved axially within the bore such that the valve removal plug 60 can be inserted inside the component to which the tool is attached and the curved part of the drive member can change along its axial length as the drive member is moved axially within the bore.

The second end 13 is connected, as shown in FIG. 4 at joint 30, to the hydraulic cylinder 18 which is connected at its other end to a rotational drive means as shown in more detail in FIG. 5.

The hydraulic cylinder 18 includes a first part 40 and a second part 41. The first part 40 is connected at a first end 42 to the drive member 21 and is slidable relative to second part 41. A hydraulic chamber 43 is defined between the first member 40 and the second member 41. The first part 40 acts therefore as a piston in conjunction with the end wall 45 of the drive member such that, as hydraulic pressure is supplied through port 70 into channel 44 within the second part, the hydraulic pressure enters the chamber 43 and primarily acts on end wall 45 to cause the drive member to be moved axially within the bore 20.

The cylinder operates, in the drive mode, by "constant pressure" which means that, on the forward or power stroke, hydraulic pressure is supplied through port 70 and port 71 such that hydraulic force is supplied into the annulus 72 between the first part 40 and the outer cylinder member 50 and also through channel 44 within the second part and into chamber 43 to act on end wall 45.

To return the hydraulic cylinder to the position shown in FIG. 2, the pressure is applied only to the annulus 72 via port 71 and fluid from port 70 is returned to a bulk reservoir. This has two advantages:

Firstly, and the primary advantage is that, as the pressure areas on both sides of the seals 47 in FIG. 4 are equal, the operator knows that to balance the pressure in the wellhead, he has only to apply equivalent pressure in the hydraulic cylinder of the tool, with a little extra to account for friction. Secondly, as the pressure required to return the piston is much less than the pressure required for the forward stroke, the piston head seals 49 are subjected to minimal loadings. This means that they can be smaller and cheaper, and typically take the form of o-ring seals.

As can be seen in FIG. 4, the joint 30 is made up of a pair of flange connectors 46 and includes double barrier packing in the form of two suitable high pressure hydraulic seals 47. The flange connectors are held together by connection means 48, typically a nut and bolt combination. The seals 47 in FIG. 4 allow the first part 40 with the hydraulic cylinder to slide therethrough, but, together with o-ring seals 49, maintain a pressure barrier between the first pressure zone in bore 20 and a second pressure zone within the hydraulic cylinder 18, namely in the hydraulic chamber 43 and between the first part 40 of the hydraulic cylinder and an outer cylinder member 50.

Figure 3:
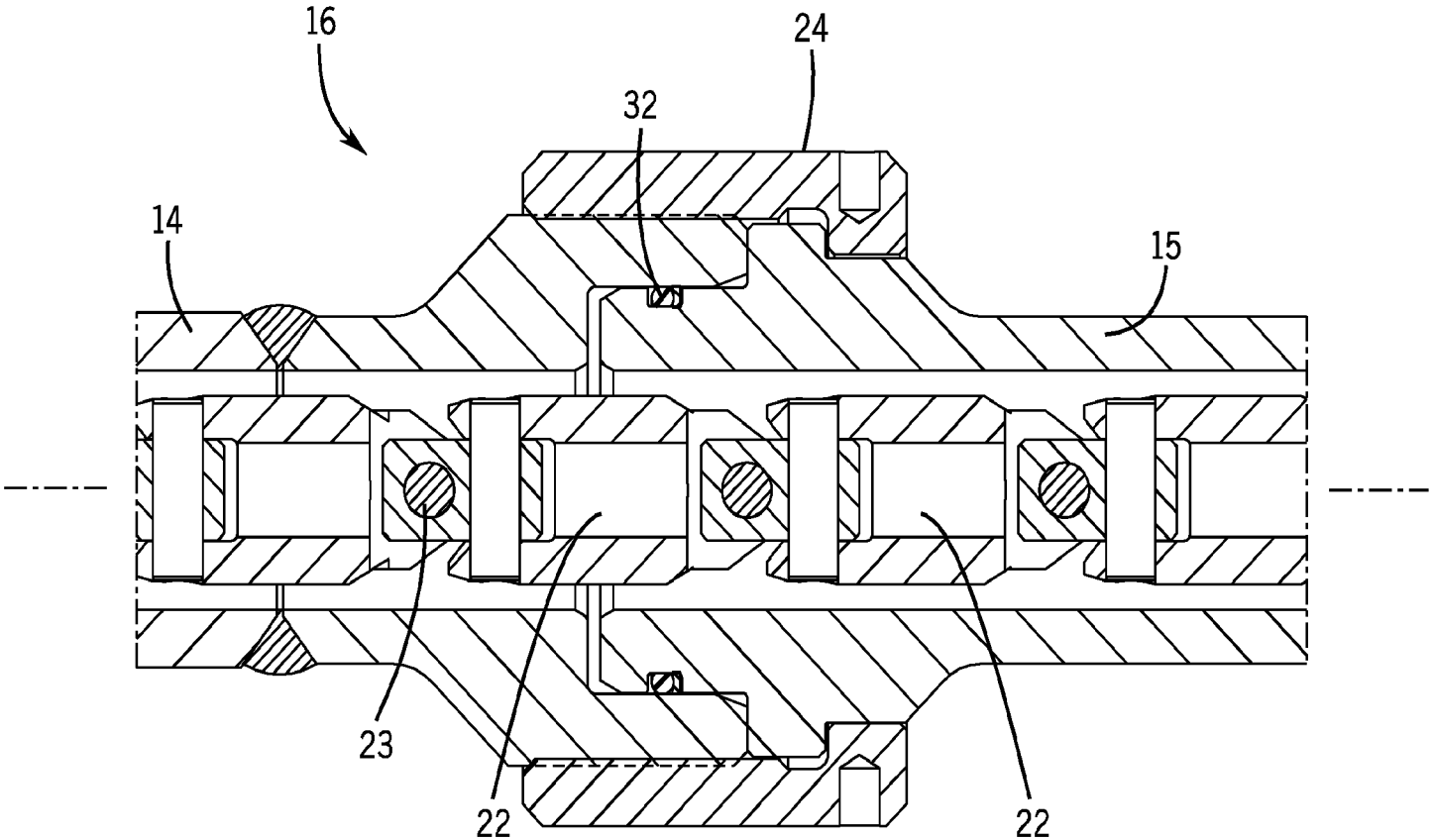
FIG. 3 is a close up view of the area identified by line 3-3 in FIG. 2.

As can be seen in FIG. 3, the joint 16 enables the curved part 14 of the pressure containing housing to be connected to the straight part 15. A pressure sealing ring 32, such as an o-ring, provides a fluid tight seal between overlapping portions of part 14 and part 15.

The joint 16 is held together by virtue of nut 24 inserted on an outer portion of both curved part 14 and straight part 15 and clamps overlapping portions of the two parts together enabling the o-ring seal to provide the fluid type barrier therebetween.

FIG. 5 illustrates the rotatable end 19 of the hydraulic cylinder 18. The second part 41 of the hydraulic cylinder is either connected or integrally formed with a rotatable element 51 such that external rotation applied to the drive profile of element 51 causes rotation of the first and second parts of the hydraulic cylinder, thereby allowing the rotational drive of element 51 to be transmitted to the drive member 21. As will be appreciated, the first and second parts 40 and 41 may be constructed or connected in any suitable manner (e.g., mating surfaces, such as cooperating hexagonal profiles of the exterior of the second part 41 and the interior of the first part 40, or a keyed arrangement) to enable transmission of such rotational drive from element 51 to the drive member 21.

FIG. 6 shows the first end 12 of the pressure containing housing connected to a swivel flange 17 which enables the tool to be connected to the appropriate wellhead component.

The invention claimed is:

1. A tool for installing and removing a valve removal plug from wellhead components, the tool comprising:

an axially curved pressure containing housing having a first and a second end, and a bore extending from the first end to the second end, wherein the axially curved pressure containing housing is substantially rigid and has a predefined axially curved shape;

a flexible drive member within the bore; and an actuator connected to the drive member for causing rotational movement of the drive member within the pressure containing housing; wherein the actuator comprises a hydraulic cylinder which includes a first part slidable relative to a second part, the first part is connected to the drive member, and the first part is operable to move relative to the second part under hydraulic pressure.

2. A tool according to claim 1, wherein the actuator is configured to additionally cause axial movement of the drive member within the pressure containing housing.

3. A tool according to claim 1, wherein the drive member includes a plurality of articulated joints.

4. A tool according to claim 3, wherein adjacent articulated joints are at angles of no more than 15° with respect to each other.

5. A tool according to claim 1, wherein the pressure containing housing includes a swivel flange at the first end and the actuator is connected to the pressure containing housing at the second end.

6. A tool according to claim 1, wherein the actuator further causes axial movement of the drive member.

7. A tool according to claim 1, wherein the hydraulic cylinder includes a rotatable element and enables rotation of the rotatable element to cause rotation of the second part, the rotation of the second part to cause rotation of the first part, and the rotation of the first part to cause rotation of the drive member with respect to the pressure containing housing.

8. A tool according to claim 1, further comprising double barrier packings to separate a first pressure zone in the pressure containing housing from a second pressure zone in the hydraulic cylinder.

* * * * *